US007258909B2

(12) United States Patent
Akamata et al.

(10) Patent No.: US 7,258,909 B2
(45) Date of Patent: Aug. 21, 2007

(54) LEATHER-LIKE SHEET FOR BALLS

(75) Inventors: Kazundo Akamata, Okayama (JP); Yoshio Ishihara, Osaka (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 365 days.

(21) Appl. No.: 10/791,779

(22) Filed: Mar. 4, 2004

(65) Prior Publication Data

US 2004/0185245 A1 Sep. 23, 2004

(30) Foreign Application Priority Data

Mar. 19, 2003 (JP) ..... 2003-075465

(51) Int. Cl.
*B32B 3/24* (2006.01)
*A63B 41/08* (2006.01)

(52) U.S. Cl. ..... 428/151; 428/904; 428/131; 473/594; 473/614; 473/607; 473/604; 473/603; 473/596

(58) Field of Classification Search ..... 428/151, 428/904, 131; 473/594, 614, 607, 604, 603, 473/596

See application file for complete search history.

(56) References Cited

U.S. PATENT DOCUMENTS 5,813,932 A * 9/1998 Grafton ..... 473/594

6,024,661 A 2/2000 Guenther et al.

FOREIGN PATENT DOCUMENTS

JP 06264369 A * 9/1994

OTHER PUBLICATIONS

Derwent Publications, AN 1994-338802, XP-002285352, JP 06-264369, Sep. 20, 1994.

Patent Abstracts of Japan, JP 08-013351, Jan. 16, 1996.

Derwent Publications, AN 1991-040527, XP-002285353, JP 02-307726, Dec. 20, 1990.

* cited by examiner

*Primary Examiner*—William P. Watkins, III
(74) *Attorney, Agent, or Firm*—Oblon, Spivak, McClelland, Maier & Neustadt, P.C.

(57) ABSTRACT

The leather-like sheet for balls of the present invention comprises a fiber-entangled fabric and a porous surface layer disposed on the surface of the fiber-entangled fabric. The porous surface layer has a pattern formed by a plurality of outwardly projecting pebbles and valleys between the pebbles. A plurality of microholes having an average diameter of 5 to 100 μm are formed on surfaces of the pebbles, but the microhole is substantially not formed on surfaces of the valleys. The leather-like sheet exhibits a sufficient surface abrasion resistance and an excellent non-slip properties because of its high sweat-absorbing ability under wet conditions.

21 Claims, No Drawings

LEATHER-LIKE SHEET FOR BALLS

BACKGROUND OF THE INVENTION

1. Field of the Invention

The present invention relates to a leather-like sheet capable of providing balls having a sufficient surface abrasion resistance and an excellent non-slip properties because of its high sweat-absorbing ability, and more particularly to a leather-like sheet for balls which is suitable as materials for various balls such as basketball, American football, handball and rugby ball.

2. Description of the Prior Art

Hitherto, a number of leather-like sheets for ball materials have been proposed as a substitute for natural leathers. Materials for balls are frequently required to have good non-slip properties. As the production method of a non-slipping leather-like sheet, there has been proposed, for example, a method of coating a surface of a base fabric with a coating composition containing a polyurethane resin having hydroxyl groups in its molecule, a liquid rubber having hydroxyl groups in its molecule, an inorganic or organic filler, and an isocyanate prepolymer (Japanese Patent Publication No. 7-30285, pages 2-3). However, the leather-like sheet produced by the above method is not suitable for long-term continuous use, because the ability to absorb sweat is easily lost when exceeding the absorption limit, although the coated surface absorbs sweat from hands to some extent. Also, since the resin, etc. having absorbed sweat becomes plasticized and the original hand feel is lost, the proposed leather-like sheet is not suitable for continuous use.

In another proposed method, a nonwoven fabric impregnated with a coagulated elastomeric resin is sliced along its intermediate layer (Japanese Utility Model Application Laid-Open No. 63-197475, pages 2-3). However, the leather-like sheet produced by the above method is very tacky and soft to exhibit a low surface strength, thereby failing to withstand the use under severe conditions, particularly, as in basketball game.

In still another proposed method, the surface of a heat-foamed product made from a rubber material incorporated with gelatin is made into a porous structure by removing a part of its surface skin layer and then removing gelatin by hot water from the surface (Japanese Patent Application Laid-Open No. 63-152483, pages 2-3). However, the leather-like sheet having a porous structure made by removing gelatin using hot water or having a porous surface layer containing a penetrant is also very tacky to have an insufficient abrasion resistance and not suitable as materials for balls.

There has been also proposed a leather-like sheet for balls which comprises a porous base layer made of a fiber-entangled fabric, a porous elastomer and a penetrant and a porous surface layer formed thereon. Microholes are formed on the porous surface layer and the penetrant is present in microholes (Japanese Patent Application Laid-Open No. 2000-328465, pages 2-3). The proposed leather-like sheet for balls is excellent in the initial sweat-absorbing ability because microholes are formed throughout its entire surface. However, in surface-pebbled balls such as basketball made thereof, the sweat-absorbing ability tends to be reduced during long-term use to make the handling properties and surface touch insufficient, because dirt easily deposits between pebbles and deposited dirt is difficult to be removed. Since microholes are present over the entire pebbled surface, the pebbled surface is likely to lose its original patterns during long-term use if the number of the microholes is large. If the number of the microholes decreases to avoid the lost of the original surface pebbled pattern, the sweat-absorbing ability is reduced, and additionally, the handling properties and surface touch tend to become insufficient.

There has been also proposed a sweat-absorbing game ball that comprises a polyurethane-impregnated fibrous material and an outer coating of wet-coagulated polyurethane thereon. The surface of the outer coating includes a plurality of projecting pebbles and valleys therebetween. A plurality of openings are formed on the side surfaces of the pebbles (U.S. Pat. No. 6,024,661, pages 4-5). However, since only the side surfaces of the pebbles are made porous by a plurality of openings, dirt easily deposits to valley between the pebbles, particularly to the side surface of the pebbles and is difficult to be removed. During long-term use, dirt accumulates to reduce the effect of sweat absorbing and make the surface touch poor.

SUMMARY OF THE INVENTION

An object of the present invention is to provide a leather-like sheet suitable as a material for balls, particularly such as American football, basketball, handball and rugby ball, which is capable of providing balls free from slip due to moisture such as sweat and rain, excellent in the handling properties, and having a sufficient abrasion resistance and mechanical strength.

As a result of extensive researches in view of the above object, the present invention has been accomplished. Thus, the present invention provides a leather-like sheet for balls comprising a fiber-entangled fabric and a porous surface layer disposed on a surface of the fiber-entangled fabric, the porous surface layer having a pattern formed by a plurality of outwardly projecting pebbles and valleys between the pebbles, and a plurality of microholes having an average diameter of 5 to 100 μm being formed on surfaces of the pebbles, but the microhole being substantially not formed on surfaces of the valleys.

The average spacing between adjacent microholes is preferably 5 to 100 μm, and the number of microholes on the pebble surface is preferably 100 to 1,000/mm$^2$. The average height difference between the pebbles and valleys in the pattern is preferably 100 to 500 μm. The microholes on the pebbles are preferably formed by buffing. In addition, it is preferred to apply a softening agent to the surfaces of the pebbles.

The present invention further provides a ball at least a part of which is made of the leather-like sheet.

Since the leather-like sheet for balls of the present invention is sufficient in the surface abrasion resistance and excellent in the sweat-absorbing ability, balls made thereof are excellent in the handling properties and surface touch. Because of a high sweat-absorbing ability even under wet conditions, the leather-like sheet for balls of the present invention and balls made thereof are excellent in the non-slip properties.

DETAILED DESCRIPTION OF THE INVENTION

The fiber-entangled fabric used in the present invention may be knitted or woven fabric, nonwoven fabric, etc. which are preferably made of microfine fibers. The fiber-entangled fabric may be impregnated with an elastic polymer, if desired. Conventionally known leather-like sheet substrates may be usable as the fiber-entangled fabric without particular limitations. In particular, three-dimensionally entangled nonwoven fabrics of microfine fibers impregnated with a spongy elastic polymer are preferably used for the production of sewn balls in view of its suitability for sewing, touch and feel of balls and rebound required for balls.

The fibers for forming the fiber-entangled fabric may include, but not limited to, cellulose-fibers, acrylic fibers, polyester fibers, polyamide fibers, etc. These fibers may be used singly or in combination of two or more. Preferred are microfine fibers having an average fineness of preferably 0.3 dtex or less, more preferably 0.0001 to 0.1 dtex, because a soft feel closer to natural leathers can be obtained. The microfine fibers may be produced by a method of directly spinning microfine fibers having an intended average fineness, or a method of first spinning microfine fiber-forming fibers having a fineness larger than the intended fineness and then converting the microfine fiber-forming fibers into microfine fibers having the intended average fineness. In the method of utilizing the microfine fiber-forming fibers, the microfine fibers are generally formed from composite-spun or mix-spun fibers of two or more kinds of incompatible thermoplastic polymers by removing at least one polymer component by extraction or decomposition, or by dividing or splitting along the boundary between the component polymers. Examples of the microfine fiber-forming fibers of the type to remove at least one polymer component include so-called sea/island fibers and multi-layered fibers. By removing the sea component polymer from the sea/island fibers or removing at least one layer component polymer from the multi-layered fibers by extraction or decomposition, a bundle of microfine fibers made of the remaining island component is obtained. Examples of the microfine fiber-forming fibers of the type to be divided or split along the boundary between the component polymers include so-called petaline multi-layered fibers and multi-layered fibers, which are divided or split along the boundary between layers of different polymers into a bundle of microfine fibers either by mechanical or chemical aftertreatment.

As the island component polymer for the sea/island fibers, preferred are spinnable polymers capable of exhibiting sufficient fiber properties such as tenacity and having a melt viscosity higher than that of the sea component polymer under spinning conditions and a large surface tension. Examples of the island component polymer include polyamides such as nylon-6, nylon-66, nylon-610 and nylon-612; polyamide-based copolymers; polyesters such as polyethylene terephthalate, polypropylene terephthalate, polytrimethylene terephthalate and polybutylene terephthalate; and polyester-based copolymers. As the sea component polymer, preferred are polymers having a melt viscosity lower than that of the island component polymer, showing dissolution and decomposition behaviors different from those of the island component polymer, having a higher solubility in a solvent or decomposer for removing the sea component, and having a low compatibility with the island component. Examples of suitable sea component polymers include polyethylene, modified polyethylene, polypropylene, polystyrene, modified polystyrene, and modified polyesters.

The microfine fiber-forming fibers of sea/island type that are suitable for forming microfine fibers having a fineness of 0.3 dtex or less preferably have a sea/island ratio of 30/70 to 70/30 by volume. If the volume ratio of the sea component is 30% or more, the resultant leather-like sheet is sufficiently soft and flexible because the amount of the component to be removed by dissolution or decomposition using a solvent or decomposer is adequate, avoiding the use of a treating agent such as softening agent in an excess amount. The use of an excess amount of the treating agent may cause various problems such as deterioration in mechanical properties such as tear strength, unfavorable interaction with other treating agents, unpleasant touch or feel, and poor durability. If the proportion of the sea component is 70% or less, the amount of microfine fibers is adequate to ensure stable production of the leather-like sheet having mechanical properties sufficient for the materials of balls. In addition, since the amount of the component to be removed by dissolution or decomposition is adequate, problems such as variability of quality due to insufficient removal and disposal of removed components can be avoided. Therefore, it is industrially preferred to regulate the volume ratio within the above range in view of improving the productivity with respect to production speed, production costs, etc.

The method of producing the three-dimensionally entangled nonwoven fabric suitably used for forming the fiber-entangled fabric is not particularly restricted, and any suitable known methods are usable as long as the intended weight and density of balls are attained. Either of staples or filaments of the microfine fiber-forming fibers are made into a web by any known methods such as carding, paper-making and spun-bonding. The web is entangled by various known methods such as needle-punching and spun-lacing, singly or in combination.

Since the fiber-entangled fabric (base fabric) having a weight and density suitable as the material for balls is produced, the three-dimensionally entangled nonwoven fabric is preferably produced in the present invention by the following method. Spun fibers are drawn at a draw ratio of about 1.5 to 5 times, mechanically crimped, and then cut into staples of about 3 to 7 cm long. The staples are then carded and made into a web having a desired density by passing through a webber. Two or more webs are stacked to have a desired weight and needle-punched at a density of about 300 to 4,000 punches/$cm^2$ using a single- or multi-barb needle to entangle fibers in the thickness direction.

Next, the precursor for the fiber-entangled fabric such as the three-dimensionally entangled nonwoven fabric may be impregnated with an elastomeric polymer, if required. A solution or dispersion of the elastomeric polymer is impregnated into the precursor for the fiber-entangled fabric by any known methods such as dip-nipping, knife-coating, bar-coating, roll-coating, lip-coating and spray-coating either in single or combined manner, and then dry- or wet-coagulated into a spongy structure having a number of voids. Known elastomeric polymers that have been generally used for the production of leather-like sheets may be used in the present invention. Examples of preferred elastomeric polymers include polyurethane resins, polyester elastomers, rubber resins, polyvinyl chloride resins, polyacrylic acid resins, polyamino acid resins, silicone resins, modified products thereof, copolymers thereof, and mixtures thereof. After impregnated into the precursor for the fiber-entangled fabric in the from of an aqueous dispersion or a solution in organic solvent, the elastomeric polymer is made into the spongy structure mainly by a dry-coagulation for the aqueous dispersion or by a wet-coagulation for the solution in organic solvent. It is preferred to add a heat-sensitive gelling agent into the aqueous dispersion, because the elastomeric polymer is coagulated uniformly in the thickness direction by a dry-coagulation, optionally in combination with steaming, far infrared heating, etc. The solution in organic solvent is used preferably in combination with a coagulation modifier to form uniform voids. By coagulating the elastomeric polymer impregnated into the precursor for the fiber-entangled fabric, especially impregnated into the three-dimensionally entangled nonwoven fabric, into the spongy structure, a fiber-entangled fabric/elastomeric polymer composite having a natural leather-like feel and various properties suitable as the materials for balls is finally obtained.

In view of well-balanced feel and well-balanced properties of the resultant fiber-entangled fabric/elastomeric polymer composite, polyurethane resins are preferably used in the present invention as the elastomeric polymer. Typical examples of the polyurethane resins are those produced by the reaction in a predetermined molar ratio of at least one polymer diol having an average molecular weight of 500 to 3,000 selected from the group consisting of polyester diols, polyether diols, polyester ether diols, polylactone diols and polycarbonate diols; at least one organic diisocyanate selected from the group consisting of aromatic, alicyclic and aliphatic diisocyanates such as tolylene diisocyanate, xylene diisocyanate, phenylene diisocyanate, 4,4'-diphenylmethane diisocyanate, 4,4'-dicyclohexylmethane diisocyanate, isophorone diisocyanate and hexamethylene diisocyanate; and at least one chain extender selected from the group consisting of low-molecular compounds having at least two active hydrogen atoms such as diols, diamines, hydroxylamines, hydrazines and hydrazides. These polyurethanes may be used in combination of two or more, or may be used as a polymer composition incorporated with a polymer such as synthetic rubbers, polyester elastomers and polyvinyl chloride.

When the precursor for the fiber-entangled fabric is constituted by the microfine fiber-forming fibers described above, the microfine fiber-entangled fabric (base fabric) impregnated with the elastomeric polymer is obtained by converting the microfine fiber-forming fibers into bundles of microfine fibers before or after the impregnation and coagulation of the solution or dispersion of the polymeric elastomer. When the microfine fiber-forming fibers are of the sea/island type, the microfine fiber-forming treatment after the impregnation and coagulation forms interstices between the microfine fiber bundles and the elastomeric polymer as a result of removal of the sea component polymer. The interstices weaken the binding of the microfine fiber bundles by the elastomeric polymer to make the feel of the leather-like sheet softer. Therefore, the microfine fiber-forming treatment is preferably performed in the present invention after the impregnation and coagulation of the elastomeric polymer. On the other hand, when the impregnation and coagulation of the elastomeric polymer is performed after the microfine fiber-forming treatment, the feel of the leather-like sheet may become stiffer because the microfine fiber bundles are strongly bound by the elastomeric polymer. However, the tendency to become stiffer can be sufficiently prevented by reducing the proportion of the elastomeric polymer in the base fabric. Therefore, the impregnation and coagulation of the elastomeric polymer after the microfine fiber-forming treatment is preferably employed when a dense and firm feel which is obtained in a higher proportion of the microfine fibers is intended.

The thickness of the base fabric may be selected according to kinds, properties, feel, etc. of aimed balls, and is preferably 0.4 to 3.0 mm although not particularly limited thereto. Within the above range, the properties required as the materials for balls are ensured and the weights of balls become adequate.

The mass ratio of the microfine fibers and the elastomeric polymer in the base fabric may be appropriately selected depending on intended properties and feel. Although not critical for achieving the object of the present invention, the ratio, microfine fibers/elastomeric polymer, is preferably 35/65 to 65/35 by mass when performing the microfine fiber-forming treatment after impregnating and coagulating the elastomeric polymer, and preferably 65/35 to 95/5 by mass when performing the microfine fiber-forming treatment before impregnating and coagulating the elastomeric polymer, in view of obtaining a base fabric having a leather-like feel favorable to the materials for balls.

On the surface of the base fabric (fiber-entangled fabric optionally impregnated with the elastomeric polymer), the porous surface layer is formed, for example, by continuously applying a dispersion or solution of an elastomeric polymer on the surface in an amount determined by the clearance between the base fabric surface and a knife, a bar, a roll, etc.; dry- or wet-coagulating the applied elastomeric polymer; and drying. When the dispersion is used, the coagulation and drying are generally successively performed by a dry method with the aid of an additive such as a foaming agent. When the solution is used, it is generally preferred to coagulate the elastomeric polymer into a porous structure in a treating bath after applying a treating solution containing a poor solvent to the elastomeric polymer. When the base fabric is a fiber-entangled fabric impregnated with elastomeric polymer, it is preferred in the present invention to simultaneously complete the coagulation of the elastomeric polymer impregnated in the base fabric and the coagulation of the elastomeric polymer for forming the porous surface layer, because the drying after the coagulation can be completed by only one step, and the base fabric and the porous surface layer are integrally bonded in the resultant leather-like sheet.

Another method for forming the porous surface layer on the surface of the base fabric includes a step of coating a predetermined amount of a dispersion or solution of the elastomeric polymer on a transfer sheet such as a film or a release paper; a step of coagulating the elastomeric polymer to a porous structure and drying it in the same manner as described above to obtain a porous film; a step of integrally bonding the porous film to the base fabric through a adhesive or by coating a treating solution containing a good solvent for the elastomeric polymer on the porous film to re-dissolve the elastomeric polymer; and a step of peeling off the transfer sheet. The dispersion or solution of the elastomeric polymer coated on the transfer sheet may be bonded to the base fabric before or during the coagulation of the elastomeric polymer, thereby integrally bonding the porous surface layer to the base fabric simultaneously with the coagulation.

Like the elastomeric polymer to be impregnated into the fiber-entangled fabric, polyurethane resins are preferably used as the elastomeric polymer for constituting the porous surface layer, in view of the balance between elasticity, softness, abrasion resistance, ability of forming porous structure, etc. Examples of the suitable polyurethane resins include those to be impregnated into the fiber-entangled fabric.

The solution or dispersion of the elastomeric polymer to be applied may optionally contain additives, singly or in combination, such as colorants, light stabilizers and dispersants. In addition, other additives such as a foaming agent for dry foaming and a coagulation modifier for wet-coagulation may be preferably added singly or in combination to control the configuration of porous structure.

When polyurethane is used as the elastomeric polymer, after coating the base fabric with the solution containing polyurethane as the main ingredient, polyurethane is coagulated into porous structure by immersing the base fabric in a treating bath containing a poor solvent to polyurethane. Water is preferably used as the typical poor solvent to polyurethane. The use of a treating bath comprising a mixture of water as the poor solvent and dimethylformamide (hereinafter referred to as "DMF") as a good solvent to polyurethane makes it easy to regulate the coagulated state of polyurethane, i.e., the configuration of porous structure and shape of microholes as specified in the present invention by suitably selecting a mixing ratio of the poor and good solvents. The mixing ratio, good solvent/poor solvent, in the treating bath varies depending upon the concentration of the polyurethane solution for forming the porous surface layer, and is preferably 0/100 to 40/60 by mass for forming microholes having an average diameter of 5 to 100 μm on the surfaces of pebbles on the porous surface layer, and preferably 5/95 to 30/70 by mass for forming continuous microholes reaching the surface of the base fabric. It is particularly preferred for the microholes to be continuous to reach the surface of the base fabric, because the sweat-absorbing ability and the non-slip properties under wet conditions are enhanced.

The average height difference between the pebbles and valleys in the pebbled pattern on the porous surface layer is preferably 100 to 500 μm because good non-slip properties, handling properties and abrasion resistance are obtained. The surface area of each pebble is preferably 0.3 to 10 $mm^2$, more preferably 0.5 to 5 $mm^2$ in view of excellent sweat-absorbing ability and non-slip properties. The average height difference referred to herein means the average height difference between the top of the pebbles having microholes and the bottom of the valleys, and the surface area means the total of the substantially top areas of each pebble having microholes.

The pebbled pattern on the porous surface layer may be formed by any suitable known methods as long as they provide the pebbled pattern to balls stably, for example, by using an emboss roll, a flat emboss plate or a release paper each having a pebbled pattern suitable for balls. The flat emboss plate is not for continuous process of mass production. The height difference between the pebbles and valleys in the pebbled pattern achieved by the use of the release paper is limited substantially to 200 to 300 μm, and the pebbled pattern may lack sharpness when the height difference is close to the limit. Although such drawbacks can be eliminated by further pressing the release paper from the backside, the feel becomes stiffer because of a large required pressing force. Therefore, it is preferred to form the pattern by the emboss roll having a pebbled pattern suitable for balls.

The conditions for forming the pebbled pattern having the average height difference of 100 to 500 μm on the porous surface layer by the emboss roll are selected depending on depth of the pattern on the roll, roll temperature, pressing force, treating time, etc. When the porous surface layer is formed of polyurethane resins, the average height difference of 100 to 500 μm is attained by the embossing treatment under emboss roll temperature of 150 to 180° C., pressing force of 5 to 50 $kg/cm^2$ and treating time of 10 to 120 s. The surface of the porous surface layer may be colored either before or after the embossing treatment. To avoid the discoloration during the embossing treatment, the coloring treatment is preferably conducted after the embossing treatment. The coloring resins are not limited as long as withstanding the embossing treatment, and preferably polyether polyurethane resins and polyester polyurethane resins in view of durability and costs. Pigments excellent in heat resistance, light resistance and fastness to rubbing are preferably used as the colorants. The coloring may be performed by known methods such as gravure method, dyeing method, reverse coating method and direct coating method, with gravure method being preferred in view of productivity and costs.

The microholes having an average diameter of 5 to 100 μm are formed on the pebbles in the porous surface layer by known methods such as a buffing treatment using sandpaper or card clothing and a surface dissolution treatment by a solvent. The buffing treatment, particularly, the buffing treatment using sandpaper is preferred because the average diameter of microholes can be controlled by changing the coarse of sandpaper. For example, #180 to #600 coarse sandpapers are the most suitable to form microholes having an average diameter of 5 to 100 μm. The buffing treatment is preferred because the microholes having an average diameter specified in the present invention are efficiently and selectively formed on the pebbles. For example, in the solvent treatment to dissolve the surface of the porous surface layer by a usual solvent capable of dissolving the elastomeric polymer, the average diameter of microholes tends to be 10 μm or smaller and the microholes are rather easy to be collapsed, thereby deteriorating the touch of the surface and the sweat-absorbing ability.

Excessively strong buffing conditions may shorten the height difference between the pebbles and valleys and increase the average diameter of the microholes. Therefore, it is preferred for the buffing conditions to be gentle enough to remove only the skin layers of the pebbles, because the preferred average height difference between the pebbles and valleys in the pebbled pattern and the effect of the present invention are easily attained.

To enhance the abrasion resistance, the coloring resin described above is preferably applied to the pebbles by known methods such as gravure method and spray method, with the gravure method being preferred because the coloring resin is selectively applied to the surfaces of the pebbles after buffing treatment to enhance the surface abrasion resistance.

The average diameter of microholes is preferably 5 to 100 μm, more preferably 5 to 80 μm in view of obtaining an excellent sweat-absorbing ability, still more preferably 7 to 60 μm, and further preferably 8 to 40 μm in view of obtaining both an excellent sweat-absorbing ability and excellent anti-staining properties, and most preferably 8 to 35 μm. The microholes are formed in the surface area of each pebble, preferably from the top to 50 μm below the top, more preferably from top to 40 μm below the top, and still more preferably from the top to 30 μm below the top. It is most preferred to form the microholes only on the top surface of each pebble and its vicinity by only buffing the pebbles in view of resistance to dirt and prevention of lost of the pebbled pattern in a long-term use. If the microholes are formed in the area more than 50 μm below the top of each pebble, the microholes may be present throughout the entire pebbled pattern of the resultant ball, thereby likely to cause the reduction of mechanical strength of pebbled portions, the lost of pebbled pattern and the deterioration of surface abrasion resistance. In addition, if made into balls, the proportion of microholes which are less brought into physical contact with hands is increased to make it difficult to physically remove dirt, etc.

The average spacing between adjacent microholes present on the surface of each pebble is preferably 5 to 100 μm in view of obtaining excellent surface touch and sweat-absorbing ability. The average spacing is more preferably 10 to 70

μm in view of obtaining excellent surface touch, anti-staining properties and sweat-absorbing ability simultaneously, and still more preferably 20 to 50 μm. The average spacing between adjacent microholes can be regulated within the above range by the buffing treatment under the conditions described above.

The number of the microholes present on the surfaces of the pebbles is preferably 100 to 1,500/mm$^2$ in view of surface touch, sweat-absorbing ability, handling properties under wet conditions and abrasion resistance, more preferably 150 to 1,000/mm$^2$ in view of handling properties under wet conditions. Further, it is preferred that a part of the microholes are continuous to reach the fiber-entangled fabric because an excellent sweat-absorbing ability is obtained.

In the leather-like sheet for balls according to the present invention, a softening agent is preferably applied to at least the surface of each pebble where the microholes are formed. More preferably, the softening agent is applied to the inner wall of the microholes in view of enhancing the non-slip properties under wet conditions and the abrasion resistance.

Examples of the softening agents include amino-modified silicone compounds and epoxysilicone fatty acid esters, with the amino-modified silicone compounds being preferred in view of flexibility and abrasion resistance. The amount of the softening agent to be applied to the surface of the pebble is preferably 0.5 to 10 g/m$^2$ in terms of solid content in view of enhancing the non-slip properties and abrasion resistance of the resultant balls. The softening agent may be impregnated also into the base fabric to impart a water-absorbing ability and flexibility.

With the microholes present on the surfaces of the pebbles, the leather-like sheet for balls of the present invention can immediately absorb the moisture such as sweat coming from hands during its use, thereby allowing the ball to retain the initial hand feel and non-slip properties. Therefore, the leather-like sheet of the present invention is suitable as the materials, particularly, for basketballs, American footballs, handballs and rugby balls.

The present invention will be described in more detail with reference to the following examples. However, it should be noted that the following examples are only illustrative and not intended to limit the scope of the invention thereto. The "part" and "%" described herein are based on mass unless otherwise specified. The diameter and shape of the microholes, the height difference in the pebbled pattern, etc., are expressed by the averages of values measured on ten surface and cross-sectional scanning electron microphotographs.

The sweat-absorbing ability, surface touch and handling properties under wet conditions were evaluated by the following methods.

(1) Sweat-Absorbing Ability

A few drops of a 5% aqueous solution of isopropyl alcohol were let fall onto the surface of a leather-like sheet, and the time required until the drops disappeared by absorption into the pebbles was visually measured.

(2) Surface Touch of Leather-Like Sheet

The surface of a leather-like sheet was touched with hand by persons engaging in the production and sales of artificial leathers to evaluate the surface touch according to the following ratings. The evaluation result is shown by the most frequent rating.

Evaluation Ratings

A: Wet feel like natural leather

B: Slight but insufficient wet feel like natural leather

C: No wet feel like natural leather (3) Handling Properties Under Wet Conditions Ten testers played a basketball game in summer to evaluate the handling properties according to the following ratings. The evaluation result is shown by the most frequent rating.

Evaluation Ratings

A: Maintain sufficient gripping ability without slip of ball from hand after a long-term handling with wet hand with sweat.

B: Insufficient gripping ability with a less frequent slip of ball from hand after a long-term handling with wet hand with sweat.

C: Lack of gripping ability with a quite frequent slip of ball from hand after a long-term handling with wet hand with sweat.

EXAMPLE 1

6-Nylon (island component) and a high-fluidity low-density polyethylene (sea component) were melt-spun into sea/island mix-spun fibers (sea component/island component=50/50 by volume). The fibers were drawn, crimped and then cut into 51-mm long staples having a fineness of 3.5 dtex. The staples were carded and formed into a web by a cross-lapping method. A stack of webs was needle-punched at a density of 980 punches/cm$^2$ using single-barb felt needles to obtain a nonwoven fabric having a mass per unit area of 450 g/m$^2$. The nonwoven fabric was heat-dried, pressed to smooth its surface, and impregnated with a 16% DMF solution of polyether polyurethane, followed by the coagulation of the impregnated polyurethane in a 20% aqueous solution of DMF. Then, the nonwoven fabric was treated with hot water and hot toluene to remove the polyethylene in the fibers by extraction to obtain a porous polyurethane-impregnated base fabric made of 6-nylon microfine fibers.

A DMF solution (solid content: 20%) of polyether polyurethane ("MP-105" available from Dainippon Ink & Chemicals, Inc.) containing a brown pigment was applied onto the surface of the base fabric in a coating amount of 400 g/m$^2$, and coagulated in water to form a porous surface layer on the base fabric. After coloring the porous surface layer with a polyether polyurethane solution containing a brown pigment, a pebbled pattern was formed by using an emboss roll for basketballs at a roll temperature of 170° C. under a pressing pressure of 10 kg/cm$^2$ for 30 s. The pebbled surface was buffed at a speed of 5 m/min with a #320 sandpaper rotating at 1,000 rpm to grind the pebbles in the area from the top to 10 μm below the top.

Then, a polyether polyurethane solution containing a red pigment (solid content: 10%) was applied to the ground surface in a single coating (1 g/m$^2$ in terms of solid content) using a 150-mesh gravure roll. Further, an aqueous solution (solid content: 10%) of a softening agent ("Nicca Silicone AM-204" available from Nicca Chemical Co., Ltd.) was applied in a single coating (10 g/m$^2$ in wet basis) using a 150-mesh gravure roll. The leather-like sheet for balls thus produced had a pebbled pattern with a clear color contrast. The surface area of each pebble was 2.7 mm$^2$ in average. The microholes having an average diameter of 10 μm and an average spacing of about 20 μm were formed only on the top surfaces of the pebbles in a density of about 700/mm$^2$. A part of the microholes were continuous to reach the base fabric. The average height difference between the pebbles and valleys of the pebbled pattern on the surface was 400 μm. The leather-like sheet showed an excellent sweat-absorbing ability of 10 s by the sweat-absorbing ability evaluation and the surface touch was evaluated as A, thus being suitable as a material for basketballs.

A basketball using the leather-like sheet was rated as A by the evaluation of handling properties under wet conditions and retained the handling properties even after the long-term use in basketball game under high-temperature and high-humidity conditions.

EXAMPLE 2

The procedures of Example 1 were repeated until the embossing treatment, and then, the embossed porous surface layer was colored with the same coloring ink as used in Example 1 by a reverse coater in a coating amount of 50 g/m$^2$. The colored surface was buffed to grind the pebbles in the area from the top to 50 μm below the top, thereby forming microholes. In the leather-like sheet for balls thus produced, the microholes having an average diameter of 50 μm and an average spacing of about 20 μm were formed only on the top surfaces of the pebbles in a density of about 200/mm$^2$. A part of the microholes were continuous to reach the base fabric. The average height difference between the pebbles and valleys of the pebbled pattern on the surface was 400 μm. The leather-like sheet showed an excellent sweat-absorbing ability of 5 s by the sweat-absorbing ability evaluation and the surface touch was evaluated as A, thus being suitable as a material for basketballs.

A basketball using the leather-like sheet was rated as A by the evaluation of handling properties under wet conditions and retained the handling properties without substantial change even after the long-term use in basketball game under high-temperature and high-humidity conditions.

COMPARATIVE EXAMPLE 1

A leather-like sheet was produced in the same manner as in Example 1 except for omitting the buffing treatment. Although the average height difference between the pebbles and valleys on the surface was 500 μm, no microholes were formed on the pebbles. Even after a long-term observation for evaluating the sweat-absorbing ability, the drops were not absorbed and therefore the time taken until the drops disappeared cannot be measured. The evaluated result of the surface touch was C, indicating that the leather-like sheet thus produced was substantially identical to the conventional leather-like sheet for basketballs.

A basketball using the leather-like sheet was rated as C by the evaluation of handling properties under wet conditions and showed poor handling properties by hand wet with sweat during the long-term use in basketball game under high-temperature and high-humidity conditions. Thus, the leather-like sheet was not called as a non-slipping raw fabric.

COMPARATIVE EXAMPLE 2

6-Nylon (island component) and a high-fluidity low-density polyethylene (sea component) were melt-spun into sea/island mix-spun fibers (sea component/island component=50/50 by volume). The fibers were drawn, crimped and then cut into 51-mm long staples having a fineness of 3.5 dtex. The staples were carded and formed into a web by a cross-lapping method. A stack of webs was needle-punched at a density of 980 punches/cm$^2$ using single-barb felt needles to obtain a nonwoven fabric having a mass per unit area of 450 g/m$^2$. The nonwoven fabric was heat-dried, pressed to smooth its surface, and impregnated with a 16% DMF solution of polyether polyurethane, followed by the coagulation of the impregnated polyurethane in a 20% aqueous solution of DMF. Then, the nonwoven fabric was treated with hot water and hot toluene to remove the polyethylene in the fibers by extraction to obtain a porous polyurethane-impregnated base fabric made of 6-nylon microfine fibers.

A DMF solution (solid content: 20%) of polyether polyurethane ("MP-105" available from Dainippon Ink & Chemicals, Inc.) containing a brown pigment was applied onto the surface of the base fabric in a coating amount of 400 g/m$^2$, and coagulated in water to form a porous surface layer on the base fabric. In place of the buffing treatment, the surface of the porous surface layer was coated with DMF by a 150-mesh gravure roll, allowed to stand for 3 min, and then dried to form microholes. After coloring the porous surface layer with a polyether polyurethane ink containing a brown pigment, a pebbled pattern was formed by using an emboss roll for basketballs at a roll temperature of 170° C. under a pressing pressure of 10 kg/cm$^2$ for 30 s. Then, a 1% aqueous solution of a penetrant (polyoxyethylene octyl ether having an average molecular weight of 400) was impregnated into the resultant sheet until a liquid content reached 60%. The amount of the penetrant impregnated was 4 g/m$^2$. The resultant leather-like sheet had microholes having an average diameter of 40 μm in a density of about 1,600/mm$^2$ not only on the pebbles but also on the lower side surfaces of the pebbles and on the valleys. The average diameter of the microholes present on the surfaces of the pebbles exceeded 100 μm. The microholes having an average spacing of about 200 μm were present only on the top surfaces of the pebbles in a density of about 10/mm$^2$. A part of the microholes were continuous to reach the base fabric. The average height difference between the pebbles and valleys of the pebbled pattern on the surface was 400 μm. The leather-like sheet showed somewhat good sweat-absorbing ability of 60 s by the sweat-absorbing ability evaluation and the surface touch was evaluated as B.

A basketball using the leather-like sheet was rated as B by the evaluation of handling properties under wet conditions and showed reduction in the handling properties during the long-term use in basketball game under high-temperature and high-humidity conditions.

The leather-like sheet for balls according to the present invention exhibits a sufficient surface abrasion resistance and an excellent sweat-absorbing ability. Balls using the leather-like sheet are excellent in the handling properties and touch. In particular, because of its high sweat-absorbing ability under wet conditions, the leather-like sheet provides balls excellent in non-slip properties. The leather-like sheet of the present invention is suitable as materials for basketballs, American footballs, handballs, rugby balls, etc.

What is claimed is:

1. A basketball having at least a part thereof made of an artificial leather comprising:

a fiber-entangled fabric and a porous surface layer disposed on a surface of the fiber-entangled fabric, the porous surface layer having a pattern formed by a plurality of outwardly projecting pebbles and valleys between the pebbles; and a plurality of microholes having an average diameter of 5 to 100 μm being formed on surfaces of the pebbles, but the microholes being substantially not formed on surfaces of the valleys.

2. The basketball according to claim 1, wherein an average spacing between adjacent microholes is 5 to 100 μm.

3. The basketball according to claim 1, wherein the microholes are formed on the pebbles in a density of 100 to 1,000/mm$^2$.

4. The basketball according to claim 1, wherein an average height difference between the pebbles and valleys in the pattern is 100 to 500 μm.

5. The basketball according to claim 1, wherein the microholes present on the pebbles are formed by buffing.

6. The basketball according to claim 1, wherein a softening agent is applied to at least surfaces of the pebbles on which the microholes are present.

7. The basketball according to claim 6, wherein an amount of the softening agent applied to at least surfaces of the pebbles is 0.5 to 10 g/m$^2$ in terms of solid content.

8. The basketball according to claim 1, wherein a surface area of each pebble is 0.3 to 10 mm$^2$.

9. The basketball according to claim 1, wherein a surface area of each pebble is 0.5 to 5 mm$^2$.

10. The basketball according to claim 1, wherein the average diameter of microholes is 5 to 80 μm.

11. The basketball according to claim 1, wherein the average diameter of microholes is 7 to 60 μm.

12. The basketball according to claim 1, wherein the average diameter of microholes is 8 to 40 μm.

13. The basketball according to claim 1, wherein the average diameter of microholes is 8 to 35 μm.

14. The basketball according to claim 1, wherein the microholes are formed in a surface area of each pebble from the top to 50 μm below the top of each pebble.

15. The basketball according to claim 1, wherein the microholes are formed in a surface area of each pebble from the top to 40 μm below the top of each pebble.

16. The basketball according to claim 1, wherein the microholes are formed in a surface area of each pebble from the top to 30 μm below the top of each pebble.

17. The basketball according to claim 2, wherein the average spacing between adjacent microholes is 10 to 70 μm.

18. The basketball according to claim 2, wherein the average spacing between adjacent microholes is 20 to 50 μm.

19. A handball having at least a part thereof made of an artificial leather comprising:

a fiber-entangled fabric and a porous surface layer disposed on a surface of the fiber-entangled fabric, the porous surface layer having a pattern formed by a plurality of outwardly projecting pebbles and valleys between the pebbles; and a plurality of microholes having an average diameter of 5 to 100 μm being formed on surfaces of the pebbles, but the microholes being substantially not formed on surfaces of the valleys.

20. A rugby ball having at least a part thereof made of an artificial leather comprising:

a fiber-entangled fabric and a porous surface layer disposed on a surface of the fiber-entangled fabric, the porous surface layer having a pattern formed by a plurality of outwardly projecting pebbles and valleys between the pebbles; and a plurality of microholes having an average diameter of 5 to 100 μm being formed on surfaces of the pebbles, but the microholes being substantially not formed on surfaces of the valleys.

21. An American football having at least a part thereof made of an artificial leather comprising:

a fiber-entangled fabric and a porous surface layer disposed on a surface of the fiber-entangled fabric, the porous surface layer having a pattern formed by a plurality of outwardly projecting pebbles and valleys between the pebbles; and a plurality of microholes having an average diameter of 5 to 100 μm being formed on surfaces of the pebbles, but the microholes being substantially not formed on surfaces of the valleys.

* * * * *